US006357426B1

(12) United States Patent
Schleupen

(10) Patent No.: US 6,357,426 B1
(45) Date of Patent: Mar. 19, 2002

(54) IGNITION DEVICE FOR A HIGH-FREQUENCY IGNITION

(75) Inventor: Richard Schleupen, Ingersheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/600,513

(22) PCT Filed: Sep. 3, 1999

(86) PCT No.: PCT/DE99/02793

§ 371 Date: Aug. 30, 2000

§ 102(e) Date: Aug. 30, 2000

(87) PCT Pub. No.: WO00/29746

PCT Pub. Date: May 25, 2000

(30) Foreign Application Priority Data

Nov. 16, 1998 (DE) ..... 198 52 652

(51) Int. Cl.[7] ..... F02P 3/08; F02P 23/00

(52) U.S. Cl. ..... 123/606; 123/143 B

(58) Field of Search ..... 123/143 B, 597, 123/598, 601, 606, 607, 620, 605; 333/246, 247, 248, 99 PL

(56) References Cited

U.S. PATENT DOCUMENTS 4,446,826 A * 5/1984 Kimura et al. ..... 123/143 B
4,561,406 A * 12/1985 Ward ..... 123/606
5,049,843 A 9/1991 Reszke et al. ..... 333/246
5,131,376 A * 7/1992 Ward et al. ..... 123/598
6,009,865 A * 1/2000 Herndon et al. ..... 123/601
6,138,653 A * 10/2000 Juffinger ..... 123/598

FOREIGN PATENT DOCUMENTS

| | | |
|---|---|---|
| DE | 35 27 041 | 2/1987 |
| JP | 57 186 067 | 11/1982 |
| JP | 57 201 093 | 12/1982 |
| WO | Wo 99 37911 | 7/1999 |

OTHER PUBLICATIONS

SAE 970071., *Investigation of a Radio Frequency Plasma Ignitor for Possible Internal Combustion Engine Use*, Stiles et al, Feb. 24–27, 1997.

* cited by examiner

*Primary Examiner*—Willis R. Wolfe
(74) *Attorney, Agent, or Firm*—Kenyon & Kenyon

(57) ABSTRACT

Proposed is an igniting device having a radio frequency resonator. Moreover, the resonator can be designed as a strip waveguide on a printed-circuit board. Several resonators can be connected in a pattern to the RF source via p-i-n diodes. At the cold end, the resonator is electrically isolated but connected to ground, in terms of the radio frequency, via a capacitor. In this manner, ion currents can be simply coupled in subsequent to the application of an auxiliary voltage.

8 Claims, 5 Drawing Sheets

IGNITION DEVICE FOR A HIGH-FREQUENCY IGNITION

BACKGROUND INFORMATION

In internal combustion engines with externally supplied combustion ignition, usually spark plugs are installed in the combustion chamber of the internal combustion engine, the spark plugs essentially being composed of terminal stud, insulator, shell, and electrodes. The insulator is inserted in the tubular metallic shell, in the central bore of the insulator, in turn, an inner conductor arrangement being inserted which is composed of a central electrode on the combustion chamber side and of the terminal stud, which is distant from the combustion chamber. In this context, the rotationally symmetric axes of the shell, of the insulator, and of the inner conductor arrangement coincide. Mounted to the shell are the at least one ground electrode on the combustion chamber side so that an ignition spark forms between the central electrode and the ground electrode in response to the application of a high voltage, the spark assuring the ignition of the combustible mixture in the combustion chamber of an internal combustion engine. Usually, the ignition voltage is made available inductively by an ignition coil which assures that the voltage at the electrodes of the spark plug increases very heavily in response to disconnecting the ignition coil charging space. The function of the spark plug is to introduce the ignition energy into the combustion chamber, and to initiate the combustion of the air/fuel mixture by the electric spark between the electrodes. During the operation of the spark plug, voltages of up to over thirty Kilovolts can occur. The residues separating from the combustion process such as soot, oil, carbon, and ash from fuel and oil, are electrically conductive given certain thermal conditions. Nevertheless, no sparkovers or breakdowns may occur across the insulator in these conditions. For this reason, the electrical resistance of the insulator must be sufficiently high up to 1000° C. and may not change during the service life of the spark plugs.

Besides providing the ignition voltage inductively, it is known to generate an ignition spark by radio frequency ignition as described in SAE paper 970071 "Investigation of a Radio Frequency Plasma Ignitor for Possible Internal Combustion Engine Use". Here, the possibility of generating ignition sparks using radio frequency ignition is described. In such a radio frequency ignition, which is also called microwave ignition, a high voltage is generated by low-resistance infeed at the hot end of a quarter-wave line of an RF resonator.

SUMMARY OF THE INVENTION

In contrast, the igniting device according to the present invention has the advantage of a simple coupling out for an ion current and of a particularly simple design, respectively. Both the oscillator and the high-voltage section are advantageously seated on a shared substrate. The capacitor can likewise be arranged between the waveguide patterns on the substrate. Thus, a simple manufacture is possible, and the requirements for high-voltage strength can be taken into consideration by a corresponding form design and/or insulation level.

It is particularly advantageous to use a flexfilm as the substrate for jointly mounting the high-voltage section and the oscillator portion. Such a flexfilm offers the possibility of very simple and cost-effective manufacture.

DRAWING

DETAILED DESCRIPTION

Figure 1:
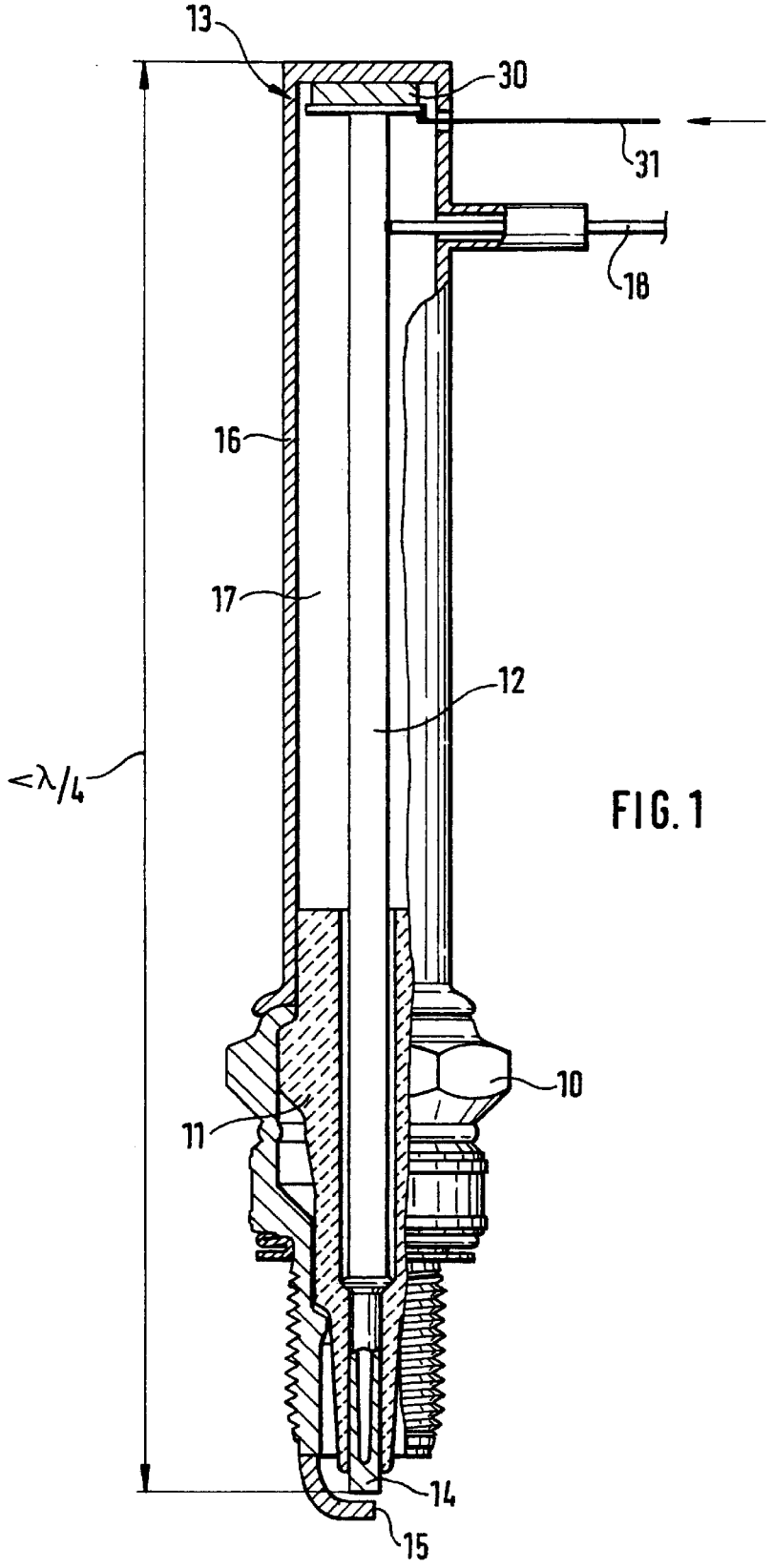
FIG. 1 shows the principle of the radio frequency ignition.

FIG. 1 depicts the functional principle of the igniting device according to the present invention. The igniting device has a metallic shell 10 including a thread used for screwing in the wall of a cylinder of an internal combustion engine. In this context, the metal shell 10 is designed as a conventional spark plug on the combustion chamber side, i.e. an insulator 11 is provided in metal shell 10, the insulator being used for electrically insulating a high-voltage feed-through lead for a central electrode 14. Arranged opposite central electrode 14 is a ground electrode 15 which is connected to metallic shell 10 in an electrically conductive manner. In response to the application of a sufficiently high voltage, an ignition spark used for igniting the gasoline/air mixture in the combustion chamber of a cylinder of the internal combustion engine sparks over in the small gap between central electrode 14 and ground electrode 15.

On the side of metal shell 10 facing away from the combustion chamber, provision is made for a radio frequency resonator used for generating the ignition voltage. The radio frequency resonator or microwave resonator has a first waveguide pattern 12 which is separated from a second waveguide pattern 16 by a dielectric 17. First waveguide pattern 12 is electrically connected to central electrode 14. Waveguide pattern 12 is contacted by a supply lead 18 through which radio frequency signals can be injected. In this context, supply lead 18 is arranged in the immediate vicinity of combustion chamber-distant end 13 of waveguide pattern 12. This end is frequently referred to as the cold end of the resonator since no high voltage is present here. At the opposed hot end, however, a high-voltage signal develops which can discharge by an ignition spark via the electrodes.

During the injection of high-voltage signals on supply lead 18, radio frequency waves form in the resonator because of the geometric conditions. If the frequency is selected correctly in proportion to the geometric dimensions, a high voltage forms at central electrode 14 which is electrically connected to waveguide 12. The geometric dimensions are to be selected such that the effective length of waveguide 12 and central electrode 14 electrically connected thereto correspond exactly to one quarter of the wavelength of the injected radio frequency. Here, effective length is to be understood as a numerical value which also allows for the dielectric properties of insulator 11 and of dielectric 17, respectively, in addition to the linear dimensions of waveguide patterns 12, 16 and of central electrode 14. In many cases, this effective length quarter-wave cannot be ascertained by calculation but by experiments only.

At end 13, which is distant from the combustion chamber, waveguide 12 is electrically connected to second waveguide 16 via a capacitor 30. With regard to the radio frequency, capacitor 30 acts as a short-circuit but is used for coupling out a current signal (ion current) via lead 31. To check whether a combustion has taken place and whether this combustion was normal or knocking, it is usual to apply a voltage of several 100 Volts to the spark plug after the ignition spark ends. The current flowing then is a) a measure for the occurred ignition with corresponding ionization, and b) the A.C. components in a specific frequency range indicate if the combustion was knocking.

The description following now is dedicated primarily to the expedient and simple design of first waveguide 12, of second waveguide 16, and of supply lead 18.

Figure 2:
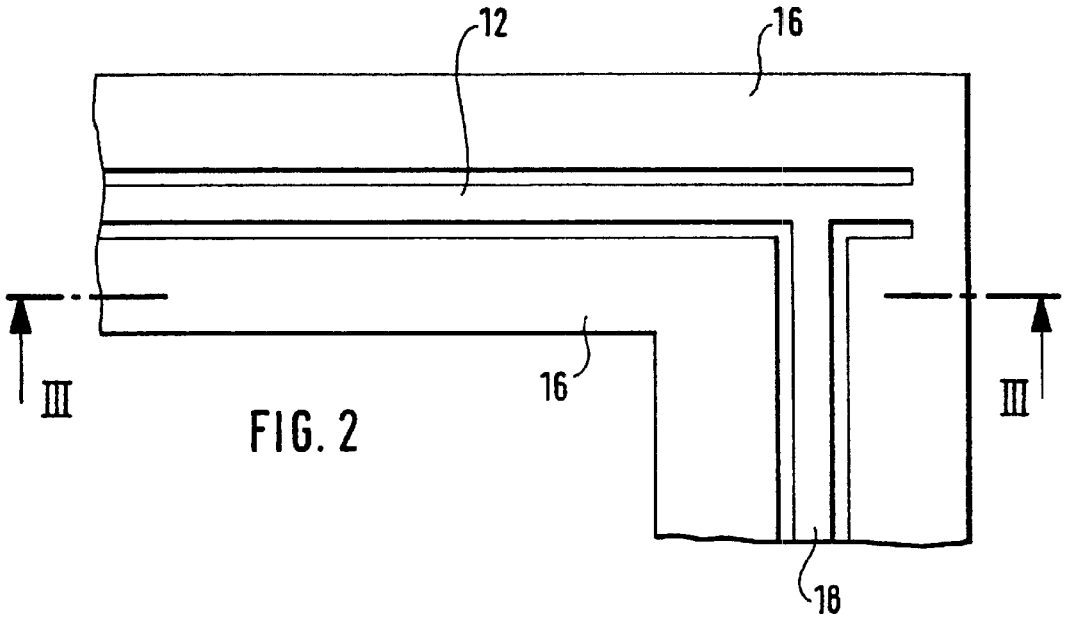
FIG. 2 illustrates one embodiment of the present invention.
Figure 3:
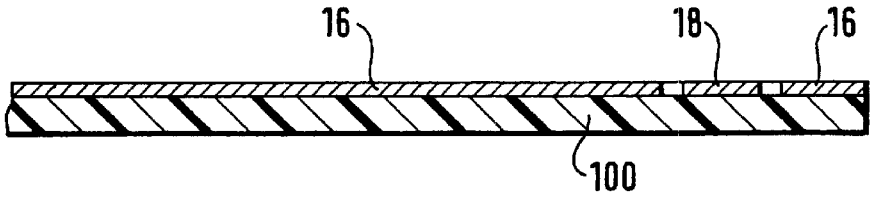
FIG. 3 illustrates another embodiment of the present invention.

FIG. 2 shows a top view of a first example, and FIG. 3 depicts a cross-section along marked line III—III of FIG. 2. As is well-discernible in the cross-section of FIG. 3, here, the construction is composed of a supporting plate or printed-circuit board 100 on whose upper side patterned metal layers are applied. The top view of FIG. 2 shows that waveguide 12 is formed as a strip waveguide on the upper side of supporting plate 100. Supply lead 18 is likewise designed as a strip waveguide which meets with strip waveguide 12 perpendicularly. Also on the upper side of supporting plate 100, waveguide pattern 16 is formed in such a manner that it surrounds strip waveguide 12 and strip waveguide 18 on both sides. Waveguide pattern 16 is also formed of a superficial conducting layer, preferably of metal, the conducting layer being applied to supporting plate 100.

Supporting plate 100 is an insulating dielectric material. The whole arrangement is preferably formed of one printed-circuit board having a superficial metal layer over the entire surface. The patterns such as strip waveguide 12, supply lead 18, and strip waveguide 16 are then formed by incorporating trenches. Since such printed-circuit boards are regularly suitable for mounting electrical components, as well, the elements needed for controlling the individual igniting devices can be mounted directly onto dielectric plates 100. In this context, it is also possible for a capacitor between the first and the second waveguide pattern, as is described with reference to FIG. 1, to be mounted directly onto the surface of the printed-circuit board. Furthermore, there are dielectric plates 100 which are flexible. This makes it possible to provide a one-part plate 100 for several cylinders of an internal combustion engine, several igniting device then being formed thereon.

Figure 4:
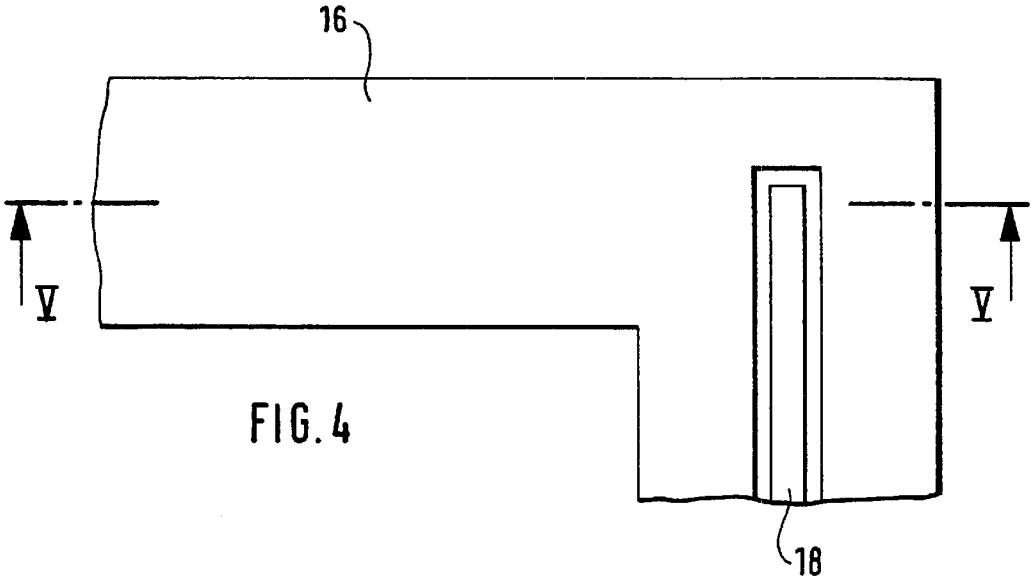
FIG. 4 illustrates another embodiment of the present invention.
Figure 5:
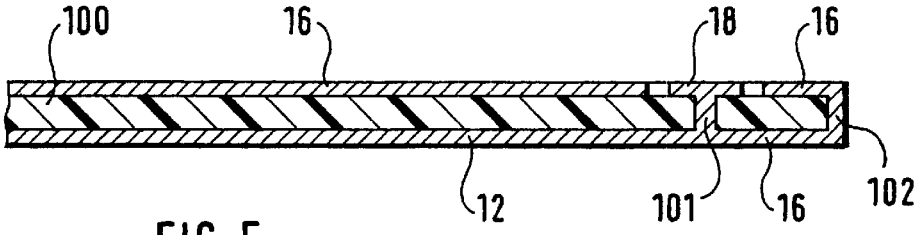
FIG. 5 illustrates another embodiment of the present invention.

FIG. 4 and FIG. 5 depict a further example for the construction of the igniting device according to the present invention. In this context, FIG. 5 shows a cross-section along line V—V of FIG. 4. FIGS. 4 and 5 illustrate an embodiment using a dielectric plate or printed-circuit board 100 coated on both sides. In this context, as is discernible in FIG. 5, supply lead 18 is formed on the upper side which is isolated by a trench pattern from the rest of the superficial metal layer which forms a waveguide pattern 16. A via 101 (see FIG. 5) is used to connect supply lead 18 arranged on the upper side to waveguide 12 arranged on the lower side. Waveguide 12 extends on the lower side of printed-circuit board 100 along line V—V. In the edge area of printed-circuit board 100, provision is made for an edge contacting 102 which provides an electrical contacting of the waveguide pattern 16 on the upper side to waveguide pattern 12 on the lower side of printed-circuit board 100. In the top view of FIG. 4, strip waveguide 12 arranged on the lower side of the printed-circuit board is not discernible.

Figure 6:
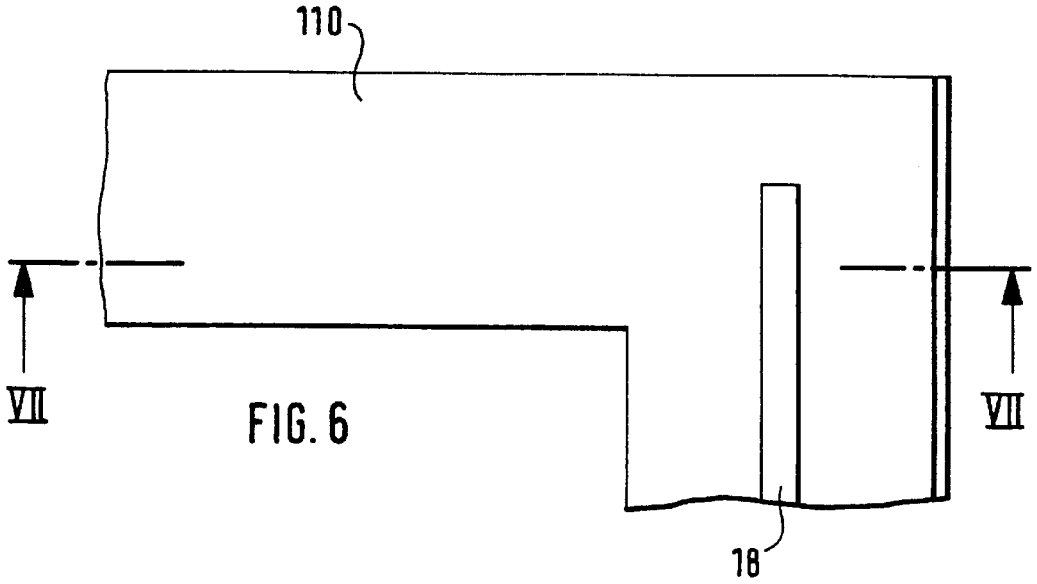
FIG. 6 illustrates another embodiment of the present invention.
Figure 7:
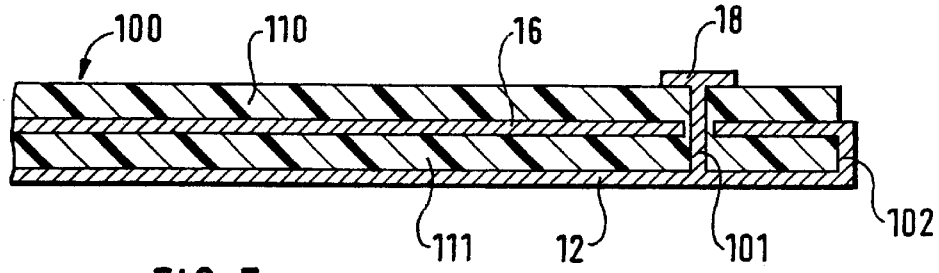
FIG. 7 illustrates another embodiment of the present invention.

In FIGS. 6 and 7, a further embodiment of the igniting device is shown. As is discernible in the cross-section of FIG. 7, this embodiment is a multilayer printed-circuit board 100 having an upper insulating layer 110 and a lower insulating layer 111 including an intermediate metallic conductor strip layer. Furthermore, another metallic conductor strip layer is provided on the upper side and on the lower side of printed-circuit board 100. In the top view of FIG. 6, supply lead 18 is discernible again. For supply lead 18 which is also designed as a waveguide and strip waveguide 12, waveguide pattern layer 16 acts as the second line of the waveguide. As shown in the cross-section of FIG. 7, provision is made again for a via 101 connecting the upper and lower side of printed-circuit board 100. Thus, an electrical contact is made between supply lead 18 designed as strip waveguide and strip waveguide 12 arranged on the lower side. In the metallic conducting layer between the two insulating layers 110, 111, waveguide pattern 16 is formed which is short-circuited to waveguide 12 by an edge contacting 102.

All examples, as are described in FIGS. 2 through 7, are preferably formed by flexible printed-circuit boards which make it possible for several igniting devices for several different cylinders to be formed in one piece from a single printed-circuit board trimmed correspondingly. Thus, the manufacturing effort for igniting devices for several cylinders is strongly simplified.

Figure 8:
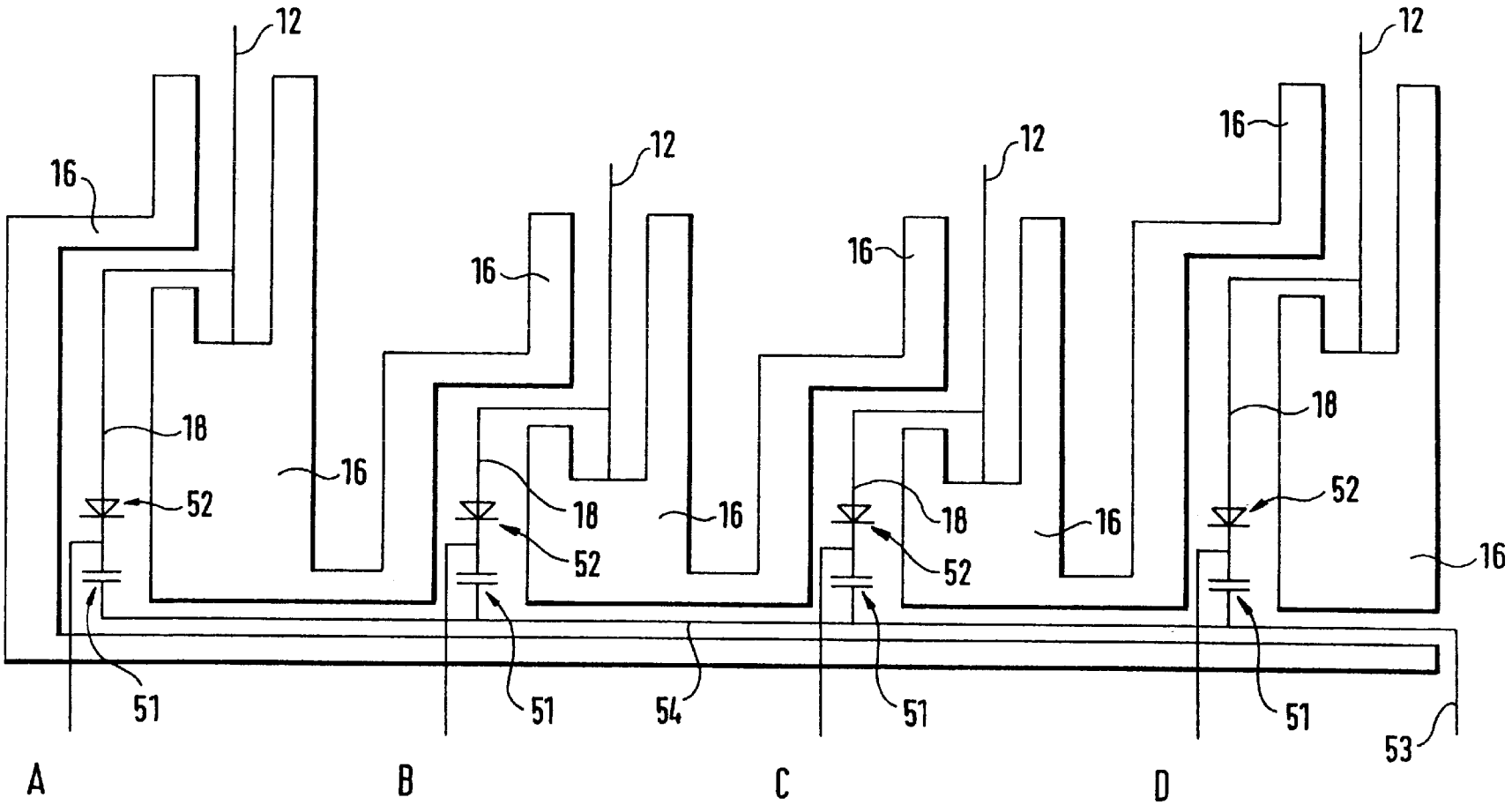
FIG. 8 illustrates another embodiment of the present invention.

FIG. 8 is a schematic representation of such a printed-circuit board 100 which includes igniting devices for four cylinders. For reasons of simplification, waveguide patterns 12 and supply leads 18 as well as other lines are shown here only as simple lines. Waveguide patterns 16 are all interconnected electrically. The individual cylinders are designated by letters A, B, C, and D. A radio-frequent signal is applied to an oscillator terminal 53. Via a distribution line 54, this radio-frequency signal is fed to the individual igniting devices for cylinders A, B, C, D. Each of these igniting devices has a capacitor 51 which is connected to distribution line 54. Capacitor 51 is then connected to supply lead 18 via a p-i-n diode 52. Provided between capacitors 51 and p-i-n diodes 52 is in each case one control current terminal. Capacitor 51 represents a short-circuit for the radio-frequency signal, whereas p-i-n diodes 52 keep the radio-frequency signal away from supply leads 18 or waveguides 12. By applying a direct voltage to terminals A, B, C, and D, p-i-n diodes 52 are switched into conduction so that then, the radio-frequency signal is also applied to supply leads 18 or waveguides 12. In this manner, the radio-frequency signal can be fed to the leads or waveguide 12 selectively for each individual cylinder.

Capacitors 51 and p-i-n diodes 52 can be affixed to the printed-circuit boards as customary, surface-mounted components. Moreover, the circuit for generating the radio-frequency signal can be applied directly to the printed-circuit board. Furthermore, the regions of the printed-circuit boards which form supply lead 18 can be designed to have different lengths to guarantee the supply to the individual cylinders which may be located at different distances. This is exemplarily depicted in FIG. 8 in that, for cylinder A and D, longer regions for supply leads 18 are shown.

What is claimed is:

1. An igniting device for an air/fuel mixture in a combustion chamber of a cylinder, comprising:

a plurality of electrodes arranged in the combustion chamber and between which an electrical energy of a high-voltage signal discharges;

a radio frequency resonator having a first waveguide pattern and a second waveguide pattern and in which the high-voltage signal is generated by supplying a radio-frequency signal in a vicinity of a cold end of the radio frequency resonator; and a capacitor through which the first waveguide pattern and the second waveguide pattern are interconnected at the cold end of the radio frequency resonator.

2. The igniting device according to claim 1, wherein:

at the cold end, an ion current flowing via the plurality of electrodes is capable of being coupled out by applying an auxiliary voltage.

3. An igniting device for an air/fuel mixture in a combustion chamber of a cylinder, comprising:

a plurality of electrodes arranged in the combustion chamber and between which an electrical energy of a high-voltage signal discharges;

a radio frequency resonator arranged outside of the combustion chamber and in which the high-voltage signal for an ignition spark is generated by supplying a radio-frequency signal; and a printed circuit board on which the radio frequency resonator is formed as a waveguide pattern.

4. The igniting device according to claim 3, wherein:

the printed-circuit board includes an upper side on which the waveguide pattern and a lead are patterned from a metallic layer.

5. The igniting device according to claim 3, wherein:

several resonators for several cylinders are formed in one piece from the printed-circuit board.

6. The igniting device according to claim 3, further comprising:

a plurality of components for performing at least one of a generation and a switch of radio-frequency signals and being arranged on the printed-circuit board.

7. The igniting device according to claim 3, wherein:

the printed-circuit board includes a plurality of metallic patterns on a first side of the printed-circuit board and on a second side of the printed-circuit board, a lead is formed on one of the first side and the second side, the waveguide pattern is formed on another one of the first side and the second side, and the lead and the waveguide pattern are electrically interconnected by a via.

8. The igniting device according to claim 7, wherein:

the printed-circuit board includes an upper insulating layer and a lower insulating layer, and the device further comprises a metallic layer incorporated as another waveguide pattern between the upper insulating layer and the lower insulating layer.

* * * * *